United States Patent [19]

Ichikawa et al.

[11] Patent Number: 4,676,157

[45] Date of Patent: Jun. 30, 1987

[54] WIPING APPARATUS FOR INTAGLIO PRINTING MACHINE

[75] Inventors: Ieyasu Ichikawa, Machida; Shigeji Arai, Matsudo, both of Japan

[73] Assignee: Komori Printing, Tokyo, Japan

[21] Appl. No.: 723,766

[22] Filed: May 28, 1985

[51] Int. Cl.[4] ..... B41F 9/08; B41F 9/14; B41F 9/16

[52] U.S. Cl. ..... 101/155; 101/168

[58] Field of Search ..... 101/155, 167, 423, 425, 101/156, 160, 162, 166, 168

[56] References Cited

U.S. PATENT DOCUMENTS

| | | | |
|---|---|---|---|
| 2,659,305 | 11/1953 | Giori | 101/155 X |
| 2,832,286 | 4/1958 | Ferguson | 101/155 |
| 3,486,444 | 12/1969 | Huck | 101/155 X |
| 3,762,319 | 10/1973 | Gazzola et al. | 101/155 |
| 4,432,282 | 2/1984 | Jurinak | 101/169 X |
| 4,499,825 | 2/1985 | Uno | 101/155 X |

*Primary Examiner*—J. Reed Fisher

*Attorney, Agent, or Firm*—Townsend & Townsend

[57] ABSTRACT

A wiping apparatus for an intaglio printing machine has a first wiping roller which is in rolling contact with a plate cylinder and which is driven in the same rotational direction as that of the plate cylinder; a second wiping roller which is in rolling contact with the first wiping roller and which is frictionally driven in the same direction as that of the first wiping roller; an ink scraper member brought into tight contact with the outer surface of the second wiping roller; an ink tray disposed under the first and second wiping rollers; and wiping paper having substantially the same width as each of the first and second wiping rollers, brought into contact therewith, and driven at a low speed in a direction opposite to that of movement of the wiping paper contacting surfaces of the first and second wiping rollers.

7 Claims, 2 Drawing Figures

WIPING APPARATUS FOR INTAGLIO PRINTING MACHINE

BACKGROUND OF THE INVENTION

The present invention relates to a wiping apparatus for wiping excess ink left on an intaglio printing surface in an intaglio printing machine.

An intaglio printing machine is known as one type of a rotary printing press. FIG. 1 is a schematic side view showing a conventional intaglio printing machine. Referring to FIG. 1, sheets 1 stacked on a feeder 2 are fed by a suction mechanism therefrom one by one. A feedboard 4 and a swing mechanism 5 are arranged between the feeder 2 and a printing unit 3 located in front of the swing mechanism 5. The feedboard 4 receives each sheet 1 fed from the feeder 2 and adjusts a printing timing. The swing mechanism 5 grips the sheet 1 and swings to transfer the sheet 1. The printing unit 3 has an impression cylinder 9. Three gripper units (to be referred to as grippers hereinafter) 8 each comprising grippers 6 and gripper pads 7 are mounted on the outer surface of the impression cylinder 9 at equal angular intervals. A plate cylinder 10 having substantially the same diameter as the impression cylinder 9 and transfer and delivery cylinders 11 and 12 having diameters substantially $\frac{1}{3}$ that of the impression cylinder 9 are brought into rolling contact with the impression cylinder 9 at different positions. Grippers (not shown) the same as the grippers 8 are mounted on the transfer cylinder 11 to transfer the sheet 1 from the swing unit 5 to the grippers 8 of the impression cylinder 9. A pair of right and left delivery chains 13 are looped around sprockets coaxial with the delivery cylinder 12 and corresponding sprockets (not shown), respectively. Delivery grippers are mounted on the delivery chains 13 to receive the sheet 1 from the grippers 8 of the impression cylinder 9 and feed it. An intaglio plate constituted by a flat surface and recesses as a printing image is mounted on the outer surface of the plate cylinder 10. A plurality of form rollers 14 are in rolling contact with the intaglio plate. Duct rollers 16 which are rotated in ink ducts 15 are in rolling contact with the form rollers 14, respectively. Ink flows from the ink ducts 15 are formed into uniform ink layers by vibrating rollers 17 which are in rolling contact with the duct rollers 16, respectively. A wiping roller 20 in a cleaning liquid tray 19 is in rolling contact with the oblique lower portion of the plate cylinder 10. It should be noted that the wiping roller 20 is rotated in the same direction indicated by the arrow as the plate cylinder 10.

In the conventional intaglio printing machine having the arrangement described above, inks of three colors are delivered by the duct rollers 16 from the ink ducts 15 and uniform ink layers are formed by the vibrating rollers 17, respectively. Thereafter, the three inks are coated on the surfaces of the form cylinders 14, respectively. In this case, the inks are applied to both the recesses of a printing area and the flat surface of a nonprinting image area. A cleaning liquid 18 is supplied to the flat surface of the plate through the wiping roller 20. Since the plate surface and the outer surface of the wiping roller 20 move in opposite directions at their contact point, ink is removed from the nonprinting area and left only in the printing area. Since a large pressure of 1 ton/cm$^2$ acts on the sheet 1 between the cylinders 9 and 10 during feeding of the sheet from the transfer cylinder 11 to the delivery chains 13 through the impression cylinder 9, inks in the recesses are transferred to the sheet 1, thereby performing copperplate printing.

There are two types of wiping systems in conventional intaglio printing machines: solvent type wiping; and water-soluble type wiping. Solvent type wiping is performed using mainly trichloroethylene, which is toxic to the human body. For this reason, since an organic solvent is difficult to handle, water-soluble type wiping has recently been widely used. According to this wiping system, an aqueous solution of sodium carbonate, Turkey red oil and a surfactant is used as the cleaning liquid 18. The removed ink is mixed with the cleaning liquid 18, and the mixture left on the outer surface of the wiping roller 20 is washed off by a brush or an abrasive resin material which is disposed in the cleaning liquid tray 19. However, such a conventional wiping apparatus has the following drawbacks.

Even though water-soluble type wiping is nontoxic, it is difficult to dispose an organic material contained in the cleaning liquid after washing. Currently the organic material is burned for their disposal. However, when water is burned or boiled and vaporized, much energy is wasted. In addition, the composition, temperature and so on of the cleaning liquid directly influence the quality of the printed products, so that a liquid circulating function and a temperature control function are required. These additional devices increase the overall cost of the printing machine. A mixture of the cleaning liquid 18 and the removed ink is precipitated like a sludge, which contaminates the cleaning liquid 18 or changes its composition. Furthermore, the quality of printed products is degraded, and need for replenishment of the liquid degrades work efficiency. Additionally, ink applied to nonprinting areas and removed by the wiping roller 20 cannot be used again, thereby wasting a large quantity of ink.

SUMMARY OF THE INVENTION

It is a principle object of the present invention to provide a wiping apparatus for an intaglio printing machine, wherein ink can be removed without using a solvent, thus preventing pollution and improving the quality of printed products, while consumption of materials and expendables can be decreased to reduce the printing cost.

In order to achieve the above object of the present invention, there is provided a wiping apparatus for an intaglio printing machine having a first wiping roller which is in rolling contact with a plate cylinder and which is driven in the same rotational direction as that of the plate cylinder; a second wiping roller which is in rolling contact with the first wiping roller and which is frictionally driven in the same direction as that of the first wiping roller; an ink scraper member brought into tight contact with the outer surface of the second wiping roller; an ink tray disposed under the first and second wiping rollers; and wiping paper having substantially the same width as each of the first and second wiping rollers, brought into contact therewith, and driven at a low speed in a direction opposite to that of movement of the wiping paper contacting surfaces of the first and second wiping rollers.

DESCRIPTION OF THE PREFERRED EMBODIMENT

Figure 1:
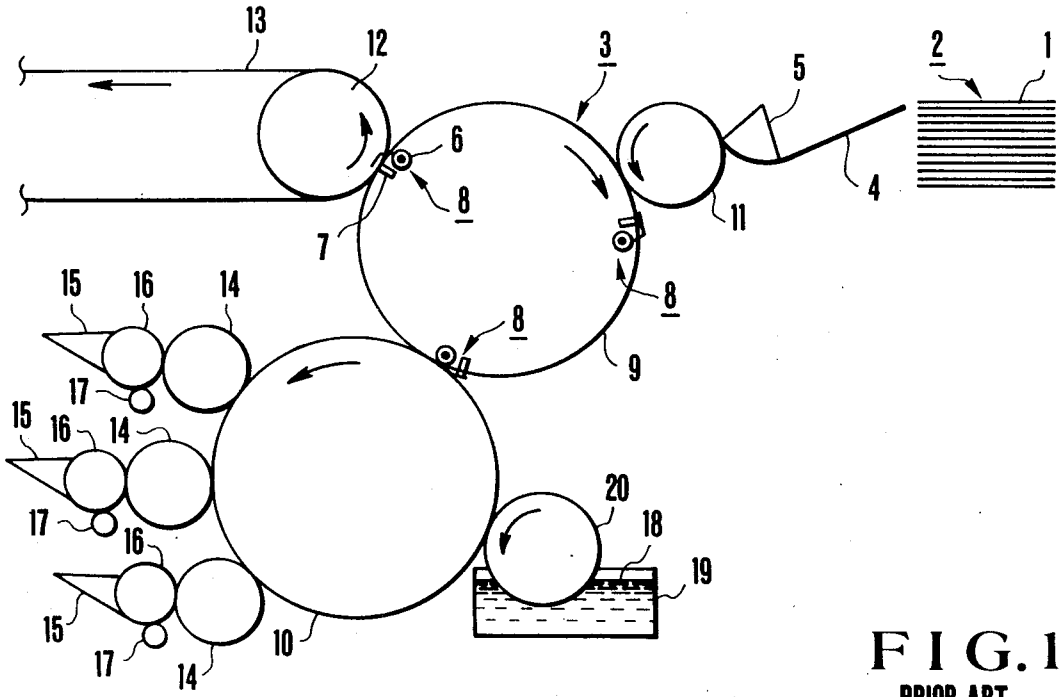
FIG. 1 PRIOR ART
FIG. 1 is a schematic side view showing a conventional intaglio printing machine.
Figure 2:
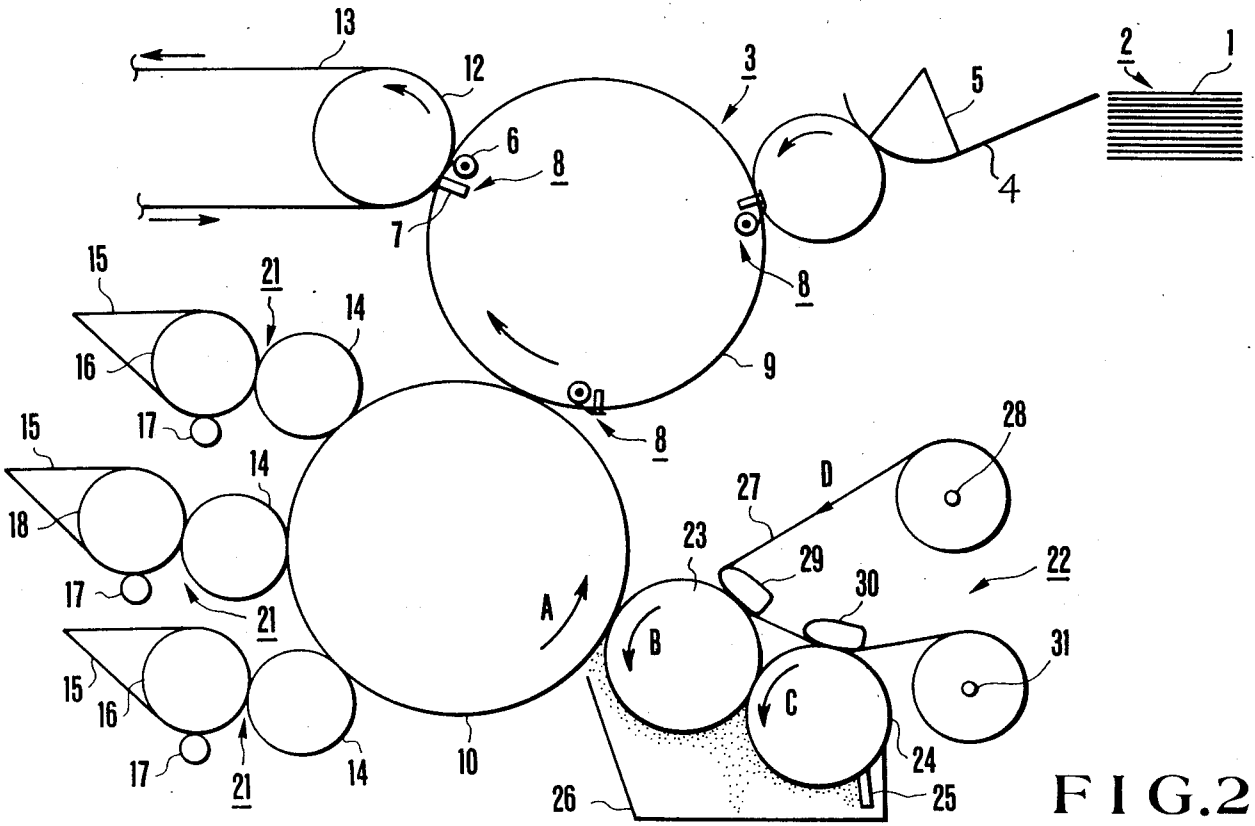
FIG. 2 is a schematic side view showing an intaglio printing machine which adapts a wiping apparatus according to an embodiment of the present invention.

FIG. 2 is a schematic side view showing an intaglio printing machine according to the present invention. The same reference numerals in FIG. 2 denote the same parts as in FIG. 1, and a detailed description thereof will be omitted.

Referring to FIG. 2, a plate having a flat surface as a nonprinting area and recesses as a printing area is mounted on the outer surface of a plate cylinder 10 rotated in the direction indicated by arrow A. Form rollers 14 in inking units 21 are in rolling contact with the plate cylinder 10. A wiping unit 22 is arranged between the form rollers 14 and the impression cylinder 9 along the downstream portion of the rotational direction of the plate cylinder 10. The wiping unit 22 has a first wiping roller 23 having an anti-wear resin (e.g., nylon, PVA or PVC) surface layer and a diameter substantially $\frac{1}{3}$ that of the plate cylinder 10 in rolling contact therewith. The first wiping roller 23 is rotated in a direction B which is the same as a direction A of the plate cylinder 10. A peripheral velocity of the first wiping roller 23 is about 1.1 to 1.5 times that of the plate cylinder 10. The first wiping roller 23 has a frictional engagement with the plate cylinder 10. In order to absorb friction heat, a pipe connected to an external pipe through a rotary joint is mounted in the first wiping roller 23, so that the first wiping roller 23 is cooled by cooling water circulated in the pipe. A second wiping roller 24 is in rolling contact with the first wiping roller 23 and has an anti-wear material (e.g., ceramic) surface layer. The first and second wiping rollers 23 and 24 are rotated in the same directions B and C such that their rolling surfaces rotate in the opposing directions. The peripheral velocity of the second wiping roller 24 is about 1.5 to 3 times that of the first wiping roller 23 and is frictionally engaged therewith. The second wiping roller 24 is also cooled by cooling water. A doctor knife 25 serves as an ink scraper member which is in contact with the outer surface of the second wiping roller 24 so as to remove ink applied to the outer surface of the second wiping roller 24. The doctor knife 25 comprises polyurethane rubber or MC nylon. An ink tray 26 is disposed under the first and second wiping rollers 23 and 24 to receive ink removed therefrom. Wiping paper 27 having substantially the same width as that of each of the first and second wiping rollers 23 and 24 is wound around a paper supply bobbin 28. The wiping paper 27 is pulled in the direction indicated by arrow D and is guided by a pair of pads 29 and 30. The wiping paper 27 is then taken up by a take-up bobbin 31. The wiping paper 27 is brought into contact with the first and second wiping rollers 23 and 24 and is fed in the direction opposite to that of movement of the wiping paper contacting surfaces of the first and second wiping rollers 23 and 24 so as to absorb ink from the surfaces thereof. The feed speed of the wiping paper 27 can be finely adjusted upon confirmation of the wiping effect. Adjusting means are arranged to control the contact pressures between the plate cylinder 10 and the first wiping roller 23, between the first and second wiping rollers 23 and 24 and between the second wiping roller 24 and the doctor knife 25, respectively.

The operation of the intaglio printing machine having the arrangement described above will be described hereinafter.

The sheet 1 fed on the feedboard 4 and gripped by the grippers of the swing mechanism 5 is transferred to the grippers 8 of the impression cylinder 9 and wound around the impression cylinder 9 upon its rotation. The sheet 1 passes between the impression cylinder 9 and the plate cylinder 10. The sheet 1 is then transferred to the grippers of the delivery chains 13 and delivered on a delivery tray or the like.

Meanwhile, inks are applied by the units 21 to the recesses of the printing area and to the flat surface of the nonprinting area around the printing area of the plate. When the plate cylinder 10 is rotated, excess ink components applied to the nonprinting area of the plate are removed by the first wiping roller 23 and are dropped into the ink tray 26 since the first wiping roller 23 is rotated in frictional engagement with the plate cylinder 10. Residual ink left on the first wiping roller 23 is removed by the second wiping roller 24 since the second wiping roller 24 is rotated in frictional engagement with the first wiping roller 23. Furthermore, ink applied to the second wiping roller 24 is removed by the doctor knife 25 and dropped into the ink tray 26. A small amount of ink left on the first and second wiping rollers 23 and 24 is removed by the wiping paper 27 which is fed in the direction opposite to that of movement of the wiping paper contacting surfaces of the first and second wiping rollers 23 and 24. The lower surface of the used wiping paper 27 can be reused. However, even if the wiping paper 27 is used once and disposed of, total cost will not greatly increase since the wiping paper is inexpensive.

As is apparent from the above description, in the wiping apparatus for the intaglio printing machine of the present invention, an additional wiping roller is arranged in rolling contact with a wiping roller brought into rolling contact with the plate cylinder and is rotated in the same rotational direction as that of the wiping roller contacting the plate cylinder. In addition, the ink scraping member is used to remove ink left on the additional wiping roller, and the roller wiping paper is also brought into contact with the rollers and is fed at a low speed in the direction opposite to that of movement of the wiping paper contacting surfaces of the first and second wiping rollers, thereby completely cleaning the surfaces of the rollers. Wiping can be thus performed without using a toxic solvent. The ink composition will not change since no organic solvent is used, thereby improving the quality of the printed products. Thus, disposal treatment is not required and increase in work efficiency and labor saving result. The material of the wiping rollers is not limited and can be selected from materials satisfying optimum wiping conditions. Furthermore, the ink can easily be recovered and recirculated to reduce printing cost. The wiping paper removes only a small amount of ink and is consumed in a very small quantity, thereby economising the wiping cost.

What is claimed is:

1. A wiping apparatus for an intaglio printing machine, comprising:

a first wiping roller which is in rolling contact with a plate cylinder and which is driven in the same rotational direction as that of said plate cylinder;

a second wiping roller which is in rolling contact with said first wiping roller and which is frictionally driven by associated drive means in the same rotational direction as that of said first wiping roller;

an ink scraper member brought into tight contact with an outer surface of said second wiping roller;

an ink tray disposed under said first and second wiping rollers; and wiping paper having substantially the same width as each of said first and second wiping rollers, brought into contact with said first and second wiping rollers, and driven at a low speed in a direction opposite to that of movement of the surfaces of the first and second wiping rollers in contact with said wiping paper.

2. An apparatus according to claim 1, wherein said wiping paper is guided by a pair of guide pads from a supply bobbin to a take-up bobbin to be urged against surfaces of said first and second wiping rollers.

3. An apparatus according to claim 1, wherein a peripheral velocity of said first wiping roller is about 1.1 to 1.5 times that of said plate cylinder.

4. An apparatus according to claim 1, wherein a peripheral velocity of said second wiping roller is about 1.5 to 3 times that of said first wiping roller.

5. An apparatus according to claim 1, wherein said first wiping roller has a surface layer of a material selected from the group consisting of nylon, polyvinyl alcohol and polyvinyl chloride.

6. An apparatus according to claim 1, wherein said second wiping roller has a surface layer of ceramic.

7. An apparatus according to claim 1, wherein said ink scraper member comprises a doctor knife of a material selected from the group consisting of polyurethane rubber and nylon.

* * * * *